US011613941B2

(12) United States Patent
Webre et al.

(10) Patent No.: US 11,613,941 B2
(45) Date of Patent: Mar. 28, 2023

(54) POWER TONG INTERLOCK SYSTEM

(71) Applicant: Frank's International, LLC, Houston, TX (US)

(72) Inventors: Charles M. Webre, Lafayette, LA (US); Dax Joseph Neuville, Broussard, LA (US); Andre Frederick, Broussard, LA (US); Joshua Thibodeaux, Arnaudville, LA (US)

(73) Assignee: FRANK'S INTERNATIONAL, LLC, Houston, TX (US)

( * ) Notice: Subject to any disclaimer, the term of this patent is extended or adjusted under 35 U.S.C. 154(b) by 411 days.

(21) Appl. No.: 16/809,028

(22) Filed: Mar. 4, 2020

(65) Prior Publication Data

US 2020/0284107 A1 Sep. 10, 2020

Related U.S. Application Data

(60) Provisional application No. 62/813,452, filed on Mar. 4, 2019.

(51) Int. Cl.

| | |
|---|---|
| ***E21B 19/16*** | (2006.01) |
| *B25B 13/54* | (2006.01) |
| *E21B 19/20* | (2006.01) |

(52) U.S. Cl.

CPC ..... *E21B 19/164* (2013.01); *E21B 19/165* (2013.01); *B25B 13/54* (2013.01); *E21B 19/163* (2013.01); *E21B 19/168* (2013.01); *E21B 19/20* (2013.01)

(58) Field of Classification Search

CPC .... E21B 19/161; E21B 19/163; E21B 19/164; E21B 19/165

See application file for complete search history.

(56) References Cited

U.S. PATENT DOCUMENTS

| | | | |
|---|---|---|---|
| 4,290,304 | A | 9/1981 | Eckel |
| 4,297,922 | A | 11/1981 | Higdon |
| 4,402,239 | A | 9/1983 | Mooney |
| 5,099,725 | A | 3/1992 | Bouligny, Jr. et al. |
| 9,995,095 | B2 | 6/2018 | Thibodeaux et al. |
| 10,006,260 | B2 | 6/2018 | Webre et al. |
| 2015/0275597 | A1 | 10/2015 | Thibodeaux et al. |

OTHER PUBLICATIONS

Seung Hoon Bahng (Authorized Officer), International Search Report and Written Opinion dated Jul. 2, 2020, PCT Application No. PCT/US2020/020951, 13 pages.

*Primary Examiner* — Kristyn A Hall

(74) *Attorney, Agent, or Firm* — MH2 Technology Law Group LLP

(57) ABSTRACT

A control system for a tong for a drilling rig includes a tong motor control valve that is selectively actuatable to cause rotation of the tong in a first direction or in a second direction, a run/pull mode selector configured to actuate between a first configuration for running tubulars into a well and a second configuration for pulling tubulars from the well, a rotation speed selector configured to actuate between a high-speed setting configured to cause the tong to be driven to rotate at a first speed, and a low-speed setting configured to cause the tong to be driven to rotate at a second speed, and a rotation change control device configured to selectively prevent or permit actuation of the tong motor control valve based on the configuration of the run/pull mode selector and the setting of the rotation speed selector.

20 Claims, 9 Drawing Sheets

POWER TONG INTERLOCK SYSTEM

CROSS-REFERENCE TO RELATED APPLICATIONS

This application claims priority to U.S. Provisional Patent Application having Ser. No. 62/813,452, which was filed on Mar. 4, 2019 and is incorporated herein by reference in its entirety.

BACKGROUND

Power tongs are used on drilling rigs to rotate and thereby connect together ("make-up") or disconnect ("break-out") threaded connections between adjacent tubular segments in a tubular string. The tongs typically grip a first tubular segment and rotate it relative to a second tubular segment to either make-up or break-out the connection therebetween. FIG. 1A is a perspective view of an example of such a power tong 100. The power tong 100 includes a drive motor that may be hydraulically-powered (although a variety of other power-sources could be used) and a gripping assembly coupled to the motor 110 for gripping and rotating a tubular segment received within a bay 106. A generally "c-shaped" gear housing 112 supports a pivoting door 114. The door 114 may be closed to secure the bay 106 or swung open (as indicated in FIG. 1) to provide access to the bay 106. The bay 106 is generally surrounded by the housing 112. The center of the bay 106 is between a pair of generally opposed, pivotable gripping jaws 120, each having a generally arcuate gripping surface facing radially inward toward the center of the bay 106.

Manufacturer specifications typically call for high torque to properly make-up connections, e.g., on the order of thousands, up to tens of thousands of ft-lbs of torque. The components of a power tong thus are capable of producing and sustaining such high torque loads to rotate tubular segments to full make-up torque. As such, safely and effectively handling tubular members within an oilfield environment is a priority.

The process of making up and running a tubular (e.g., casing or production tubing) string into a wellbore directly impacts the time required to drill and case a well and consequently the cost of completing the casing/tubing running operation. However, the desire for efficiency in the process may be balanced with maintaining safe operating conditions, because tubular running presents several potential hazards. For example, the process of casing running involves operation of several pieces of equipment in concert to perform the steps of the process in a particular sequence. If the sequence is altered, which is a risk given the repetitive nature of the process, damage to equipment and/or injuries to rig personnel may occur.

As a brief overview, the casing running process may begin by bringing an add-on joint of casing from a horizontal orientation on pipe racks next to the rig floor to a vertical orientation above well center. The process may then include joining threads of the add-on casing joint to the top-most casing joint of the casing string that extends into the well (e.g., meshing helical threads of the joints together by rotating one joint relative to the other). The add-on joint, now forming part of the casing string, is then lowered into the wellbore, and then temporarily gripped and supported at the rig floor. The process then repeats, potentially several hundred times, depending on the length of the casing string.

Each piece of equipment is typically operated by a separate person. Moreover, the steps are carried out in parallel, over a period of time that can range from four to 12 or more hours, depending on the length of the casing string and wellbore conditions. With so many repetitive activities taking place, and each relying on the close coordination of several individuals, there are opportunities for human error that can result in serious personal injury.

Further, issues with connecting together the joints arise, such as cross-threading. Typical casing and production tubing threaded connections are tapered, meaning the male threaded connection resembles a shallow tapered cone and the female threaded connection is also conical in shape to match the male threaded connection. Alignment of the male connection on the end of an add-on joint of tubular with the mating female connection takes place with a full length of add-on casing hanging vertically in the derrick. Any bend in the add-on joint of casing or lateral misalignment between the add-on joint and the female threaded connection at the top of the string can result in cross-threading of the male threaded connection relative to the female connection. Cross-threading is identified when the tong operator attempts to rotate the add-on joint, as a cross-threaded joint resists rotation immediately. By contrast, a properly threaded joint rotates several revolutions with ease until the conical male threaded connection approaches full make-up into the female threaded connection.

Once a cross-threaded connection is identified, the remedy is to back the add-on joint out in order to reposition the joint into proper alignment with the female threaded connection. Backing-out takes place by reversing the direction of operation of the power tong. Initially this involves rotating the gripping elements of the power tong to establish a grip between the power tong jaws and the add-on tubular in the opposite (back-out) direction. Once the grip is established in the back out direction, the power tong rotates the add-on joint in a break-out direction (e.g., counterclockwise) to free the male connection of the add-on joint from the female connection at the top of the string.

As shown in FIGS. 1B and 1C, reversing the power tong 100 from a make-up direction to a break-out direction of operation involves repositioning of the power tong 100 and an associated snub line 150. The snub line 150 secures the tong 100 against rotation in at least one direction, e.g., counterclockwise, which prevents movement of the tong 100 during make-up operations. When the tong 100 is reversed, e.g., to break-out a cross-threaded connection, care must be taken to avoid injury to an operator 160 caused by the tong 100 quickly reversing rotation, since the snub line 150 may not prevent rotation of the tong 100 toward the operator 155. If the reversal and repositioning of the tong 100 is done with haste and the power tong 100 is not properly secured against rotation when attempting to back-out the add-on joint, the power tong 100 can rotate towards the operator 160, and may strike the operator 160, potentially severely injuring the operator 160.

SUMMARY

Embodiments of the present disclosure may provide a control system for a tong for a drilling rig. The control system includes a tong motor control valve that is selectively actuatable to cause rotation of the tong in a first direction or in a second direction, a run/pull mode selector configured to actuate between a first configuration for running tubulars into a well and a second configuration for pulling tubulars from the well, a rotation speed selector configured to actuate between a high-speed setting configured to cause the tong to be driven to rotate at a first speed, and a low-speed setting configured to cause the tong to be driven to rotate at a second speed, the first speed being greater than the second speed, and a rotation change control device configured to selectively prevent or permit actuation of the tong motor control valve based on whether the run/pull mode is in the first configuration or the second configuration and whether the rotation speed selector is in the high-speed setting or the low-speed setting.

Embodiments of the disclosure a method for controlling a tong including receiving a signal representing that a run/pull mode selector is in a first configuration associated with running tubulars into a well, and receiving a signal representing that a rotation speed selector is in a high-speed setting. The tong is configured to rotate at a first speed when the rotation speed selector is in the high-speed setting. The method also includes automatically permitting actuation of a tong motor control valve to cause the tong to rotate in a make-up direction, and automatically preventing actuation of the tong motor control valve to cause the tong to rotate in a break-out direction that is opposite to the make-up direction, until receiving a signal representing that the rotation speed selector has been actuated to a low-speed setting. The tong is configured to operate at a second speed that is less than the first speed when the rotation speed selector is in the low-speed setting.

Embodiments of the disclosure may also provide a tong including gripping jaws configured to grip a tubular, a motor configured to rotate the jaws and thereby rotate the tubular in either a make-up direction or a break-out direction, and a control system in communication with the motor. The control system includes a tong motor control valve that is selectively actuatable to cause rotation of the tong in a first direction or in a second direction, a run/pull mode selector configured to actuate between a first configuration for running tubulars into a well and a second configuration for pulling tubulars from the well, a rotation speed selector configured to actuate between a high-speed setting configured to cause the motor to drive the tong to rotate at a first speed, and a low-speed setting configured to cause the motor to drive the tong to rotate at a second speed, the first speed being greater than the second speed, and a rotation change control device configured to selectively prevent or permit actuation of the tong motor control valve based on whether the run/pull mode is in the first configuration or the second configuration and whether the rotation speed selector is in the high-speed setting or the low-speed setting.

The foregoing summary is intended merely to introduce a subset of the features more fully described of the following detailed description. Accordingly, this summary should not be considered limiting.

BRIEF DESCRIPTION OF THE DRAWINGS

The accompanying drawing, which is incorporated in and constitutes a part of this specification, illustrates an embodiment of the present teachings and together with the description, serves to explain the principles of the present teachings. In the figures.

Figure 1A:
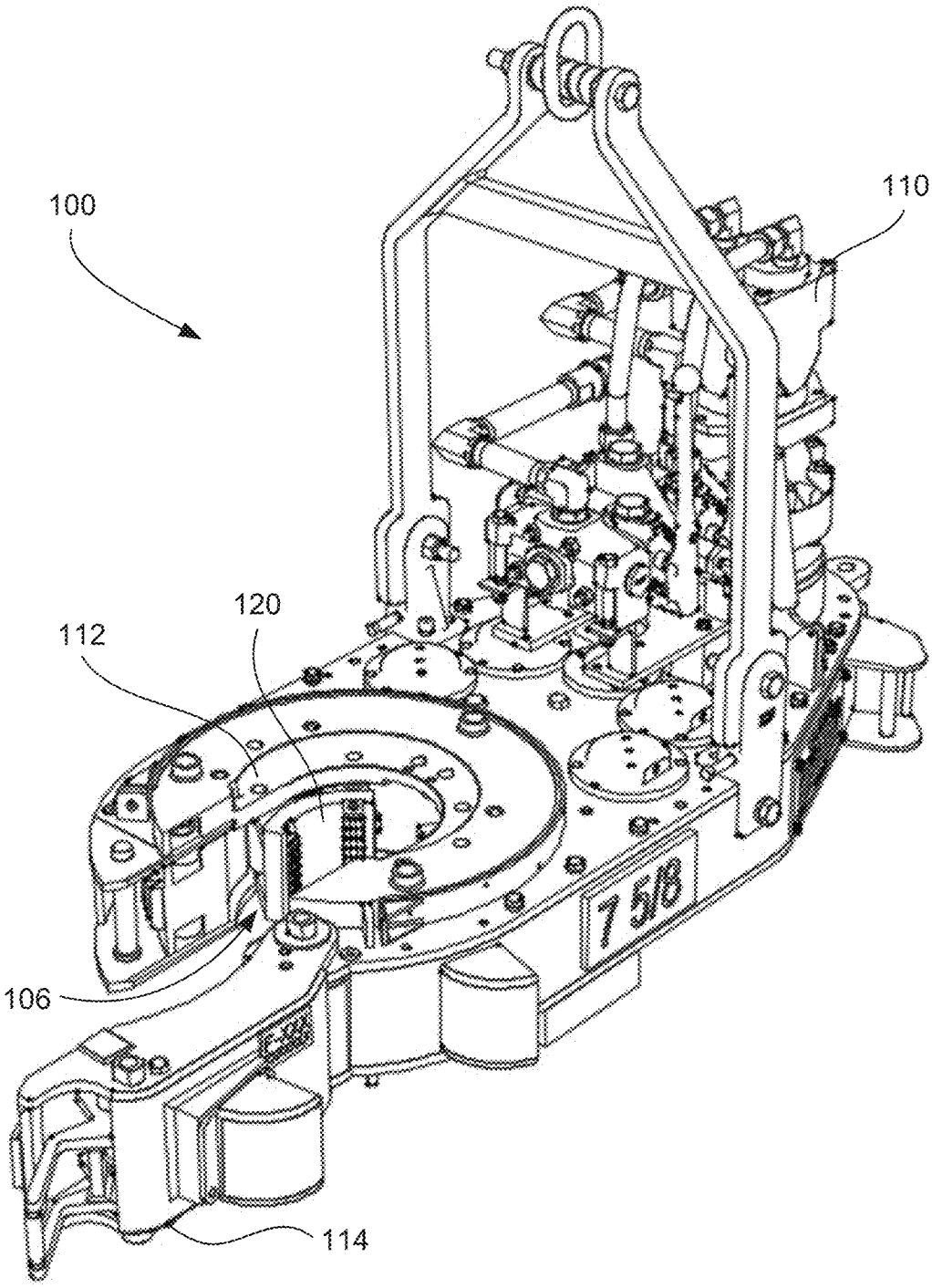
FIG. 1A (Prior Art)
FIG. 1A illustrates a perspective view of a conventional power tong.
Figure 1B:
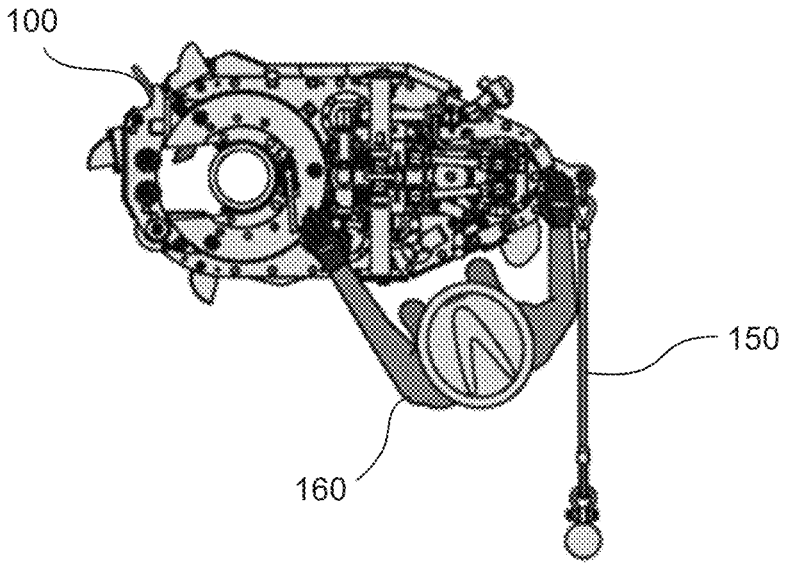
FIG. 1B (Prior Art)
FIGS. 1B and 1C illustrate top, plan views of an operator operating the conventional power tong.
Figure 1C:
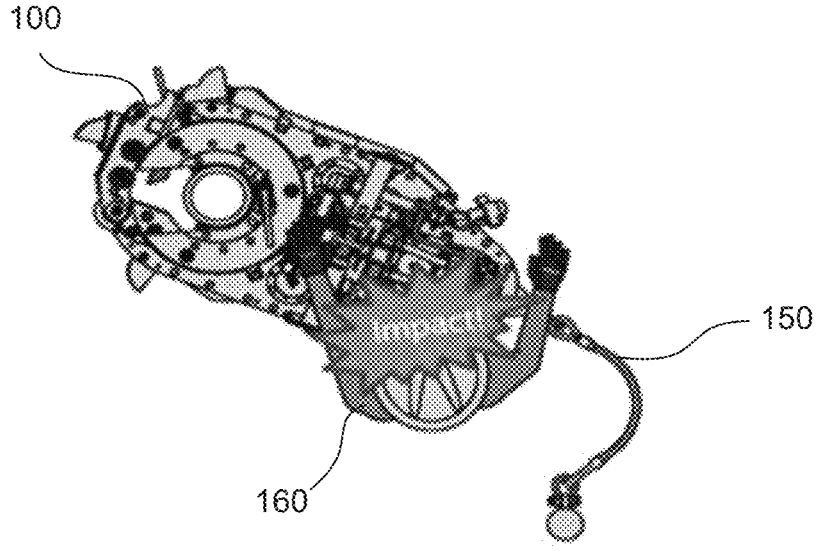
FIG. 1C (Prior Art)

It should be noted that some details of the figure have been simplified and are drawn to facilitate understanding of the embodiments rather than to maintain strict structural accuracy, detail, and scale.

DETAILED DESCRIPTION

Reference will now be made in detail to embodiments of the present teachings, examples of which are illustrated in the accompanying drawing. In the drawings, like reference numerals have been used throughout to designate identical elements, where convenient. The following description is merely a representative example of such teachings.

Figure 2:
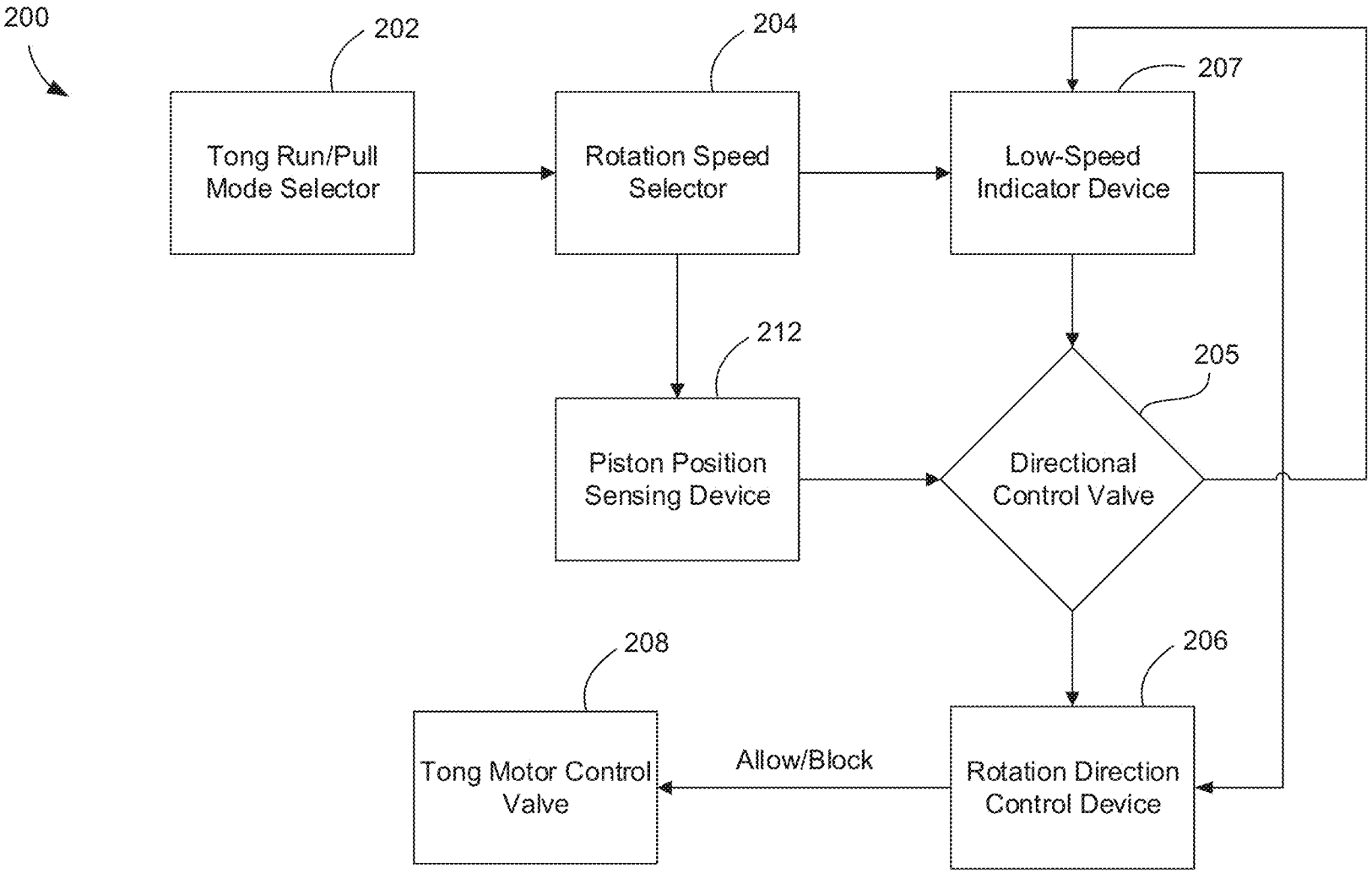
FIG. 2 illustrates a functional block diagram of an interlock control system for a power tong, according to an embodiment.

FIG. 2 illustrates a functional block diagram of a control system 200 for a tong for a drilling rig, according to an embodiment. The tong may be the tong 100 discussed above or any other tong used to rotate one tubular relative to another and thereby connect and/or disconnect the tubulars on a drilling rig. The control system 200 may be configured to control either or both of rotation and speed of the tong 100 in a manner that automatically prevents uncontrolled movement of the tong housing, which, as mentioned above, presents a hazard to rig personnel and/or equipment if not prevented.

The system 200 may include a run/pull mode selector 202, a rotation speed selector 204, a directional control valve 205 ("directional" refers to the type of valve, not necessarily rotation direction), a rotation change control device 206, a low-speed indicator device 207, a tong motor control valve 208, and a piston position sensing device 212. These components 202-212 may be configured to control the rotation direction and speed of the tong 100.

In particular, the run/pull mode selector 202 may be a switch that is configured to be set in a run or pull mode (referred to herein as "configurations") by a user/operator. The rotation speed selector 204 may likewise be a switch and may be configured to receive a high or low-speed setting from a user. The low-speed indicator device 207 may be configured to detect when the tong 100 is operating in the low-speed setting (e.g., when the rotation speed selector 204 is in the low-speed setting, and the tong has implemented the low-speed setting). The directional control valve 205 may be configured to control a speed range setting of the rotation of the tong 100, e.g., by interfacing with a gear shift cylinder that controls selection of a gear in a gear box (e.g. high gear and low gear), and thereby implement, if allowed, the speed setting of the rotation speed selector 204.

The tong motor control valve 208 may be a lever, joystick, slide, knob, etc. that is actuatable to cause the tong to rotate in a first or "make-up" direction and a second or "break-out" direction. For example, moving the tong motor control valve 208 in one direction may cause the tong 100 to rotate in the first direction, and moving the tong motor control valve 208 in the opposite direction may cause the tong 100 to rotate in the second direction. Further, the speed of rotation may be proportional to the degree of movement of the tong motor control valve 208 within two ranges, one high speed range, and one low speed range, corresponding to the high and low speed settings received using the speed selector 204 and the corresponding high and low gears engagements in the gear box.

The rotation change control device 206 may selectively permit or block actuation of the tong motor control valve 208 in response to signals provided thereto which are determined in part by control logic. The control logic receives inputs from the selectors 202, 204, along with inputs provided by system condition sensors, e.g., the low-speed indicator device 207 and the piston position sensing device 212, both of which interface with the directional control valve 205. The directional control valve 205 interfaces with a gear shift cylinder that selectively alters engagement of the gears within the tong 100 between high and low speed arrangements.

Accordingly, the system 200 may provide an interlock which selectively permits or blocks the tong motor control valve 208 causing rotation of the tong 100 in one or both rotational directions. For example, actuation of the tong motor control valve 208 may be blocked or permitted based at least partially on the configuration of the mode selector 202, the setting of the speed selector 204, and the determination by the low-speed indicator device 207. For example, as will be described in greater detail below, the components 202, 204, 205, and 207 may cooperate, e.g., as part of an electrical, pneumatic, or hydraulic circuit, to position blocking devices, e.g., pistons that selectively engage or disengage from a spool of the rotation change control device 206. When engaged, the pistons may block movement of the spool, and when disengaged, the pistons may permit movement of the spool. In turn, actuation of the tong motor control valve 208 may be permitted or blocked by permitting or allowing movement of the spool via the pistons.

In an embodiment, the piston position sensing device 212 may communicate with the blocking device (pistons) discussed above. The piston position sensing device 212 may recognize when the pistons are engaged or disengaged, and contribute to the control of the rotation change control device 206 in response, e.g., preventing shifting of the gears from low to high via the gear shift cylinder and the directional control valve 205, as will be described below.

In some embodiments, a user may attempt to cause the tong motor control valve 208 to change the direction in which the tong 100 rotates. For example, during running operations, the run/pull mode selector 202 may be in the run mode when cross-threading is detected. Thus, reversing the direction of rotation to break-out a cross-threaded operation may be desired, e.g., without changing the configuration of the mode selector 202 to the pull (as running operations may support backing out cross-threaded connections, for example). The system 200 may be configured to permit such rotation reversal, while allowing the tong run/pull mode selector 202 to remain in the run mode, but in a safe manner that prevents hazards, such as the tong 100 impacting the operator, as described above.

Thus, among other things, the system 200 may be configured to automatically prevent rotation of the tong 100 in the break-out direction when the tong 100 is configured in "run" mode and is in the high-speed setting, only allowing such rotation after actuating the rotation speed selector 204 to the low-speed setting, and, e.g., confirming such actuation has been implemented using the low-speed indicator device 207. In some embodiments, the tong 100 may likewise be prevented from reversing rotation while in the high-speed setting when in the pull mode. In some embodiments, the piston position sensing device 212 may prevent the tong 100 from actuating back to the high-speed setting, even upon the rotation speed selector 204 being actuated to the high-speed setting, at least until the tong 100 has been shifted into a neutral position, in which the tong 100 is not driven to rotate. In some embodiments, blocking the speed from changing may only be active when the tong 100 is in run mode, as other safety devices may be employed in the pull mode (e.g., the snub line).

Figure 3:
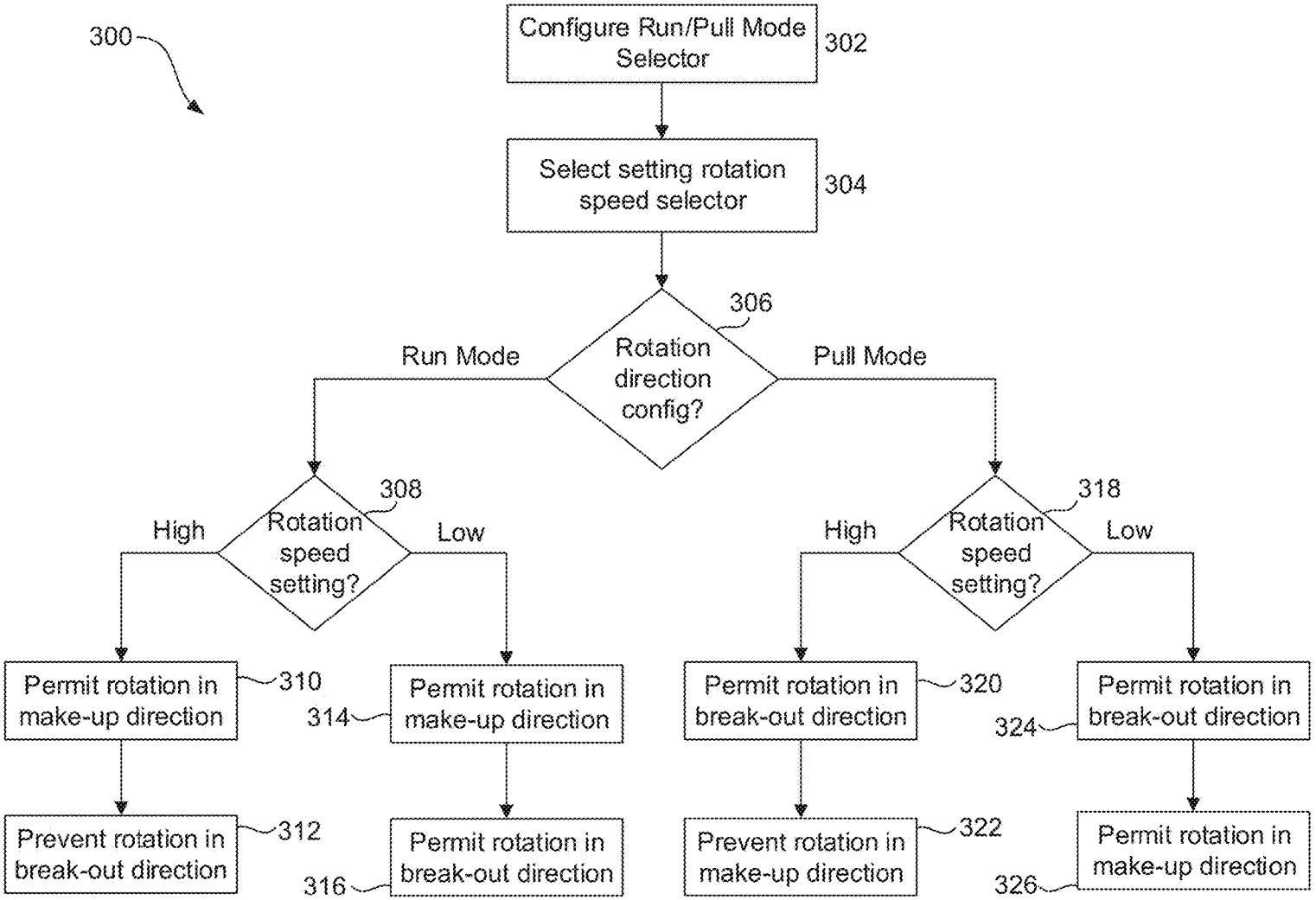
FIG. 3 illustrates a flowchart of a method for controlling a power tong, according to an embodiment.

With continuing reference to FIG. 2, FIG. 3 illustrates a flowchart of a method 300 for controlling a tong (e.g., the tong 100), according to an embodiment. The method 300 may be implemented at least in part using the system 200. The method 300 may begin by configuring the run/pull mode selector 202, as at 302. As noted above, the run/pull mode selector 202 may have a first configuration ("run mode") and a second configuration ("pull mode"). Configuring the run/pull mode selector 202 at 302 may include moving a switch from a neutral position, for example, or selecting a button, or leaving a switch in a present state, etc.

The method 300 may further include selecting a speed setting for the rotation speed selector 204, as at 304. The rotation speed selector 204 may have at least two settings, e.g., a low-speed setting and a high-speed setting (in this context, "high" means faster than low-speed, and "low" means slower than high-speed—the two terms are relative to one another and do not generally connote a specific speed). Selecting the setting may include turning a knob, flipping a switch, pushing a button, or keeping a switch in its current position. The high speed may be associated with a high gear, and the low speed may be associated with a low gear, as noted above.

These inputs may configure a circuit that provides input signals to the rotation change control device 206, which in turn allows or blocks movement of the tong motor control valve 208. Based on the configuration of the run/pull mode selector 202, the method 300 may include determining the rotation direction configuration, generally referring to the type of operation in which the tong 100 is being used ("run" refers to deploying or "running" tubulars into a well, and "pull" refers to extracting or "pulling" tubulars from the well), as at 306. Considering first the run mode, the method 300 may determine the rotation speed selector 204 setting, as at 308. When the rotation speed selector 204 is in the high-speed setting, the method 300 may proceed to 310, where the rotation change control device 206 may permit the tong motor control valve 208 to cause the tong 100 to rotate in the make-up direction at the high-speed as at 310, but may prevent the tong motor control valve 208 from causing rotation in the break-out direction (opposite to the make-up direction), as at 312 while the tong is in high gear. As such, a change in rotation direction without an accompanying change in speed selection may be prevented by preventing actuation of the tong motor control valve 208.

Referring again to block 308, when the rotation speed selector 204 is set to low-speed, the method 300 may proceed to the rotation change control device 206 permitting the tong motor control valve 208 to actuate and cause the tong 100 to rotate in either the make-up direction, as at 314, or the break-out direction, as at 316. Accordingly, it is seen that the tong motor control valve 208 is allowed to change the rotation direction of the tong 100 from make-up to break-out when the speed selector 204 is in the low-speed setting. Thus, when the speed selector 204 is in the high-speed setting, in order to change rotation direction, the speed selector 204 may first have to be actuated to the low-speed setting (and, e.g., confirmed by the low-speed indicator device 207). The method 300 may be continuous, e.g., implemented using valves in a pneumatic circuit, and thus when the speed selector 204 changes setting from the high to low-speed, the method 300 may respond by taking the low-speed branch from block 308, and then allowing rotation direction change.

Similarly, referring again to block 306, when the run/pull mode selector 202 is in the pull mode, the method 300 may proceed to block 318, in which the rotation change control device 206 may react to the rotation speed selector 204 setting and selectively preventing or permitting actuation of the tong motor control valve 208. When the rotation speed selector 204 is in the high-speed setting, the method 300 may proceed to the rotation change control device 206 permitting the tong motor control valve 208 to cause the tong 100 to rotate in the break-out direction, as at 320, but preventing the tong 100 from rotating in the make-up direction, as at 322. Referring again to block 318, when the rotation speed selector 204 is in the low-speed setting, the method 300 may proceed to the rotation change control device 206 permitting the tong motor control valve 208 to cause rotation in the break-out direction, as at 324, and permitting the tong motor control valve 208 to cause rotation in the make-up direction, as at 326. Thus, reversing direction, in this embodiment, in either the run or pull mode, is permitted only when the speed selector 204 is in the low-speed setting.

Figure 4:
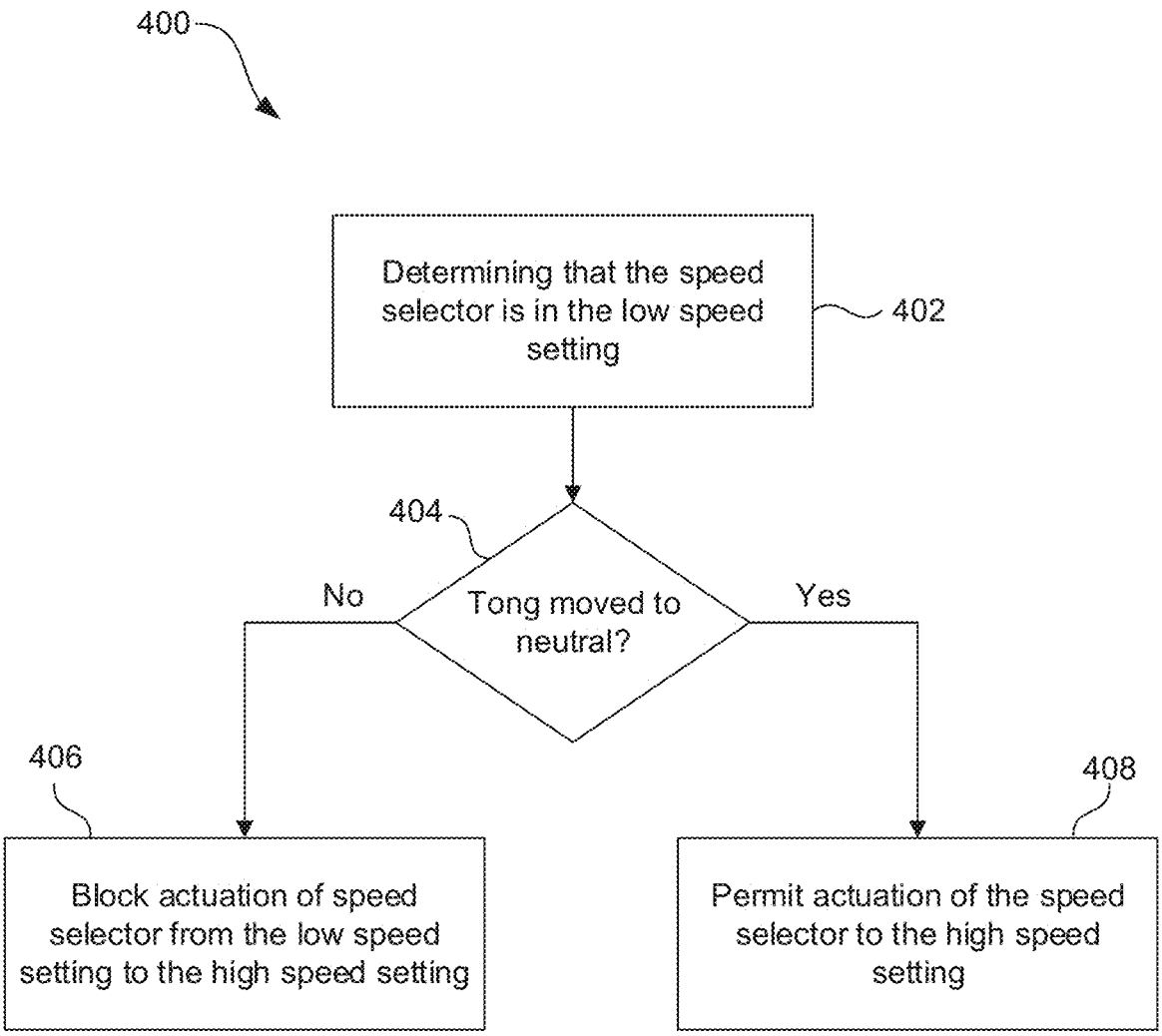
FIG. 4 illustrates a flowchart of another method for controlling a power tong, according to an embodiment.

FIG. 4 illustrates a flowchart of a method 400 for controlling speed selection of the tong 100, according to an embodiment. The method 400 may be implemented at least in part by the piston position sensing device 212 (FIG. 2), which may be, for example, a part of the pneumatic or electrical circuit that controls or otherwise implements the rotation change control device 206. In some embodiments, at least part of either or both of the rotation change control device 206 and/or the piston position sensing device 212 may be implemented using relays in an electrical circuit.

The method 400 may begin by determining that the rotation speed selector 204 is in the low-speed setting, as at 402. This may be accomplished by receiving an analog or digital electric signal, a pneumatic signal, a hydraulic signal, etc. The piston position sensing device 212 may be configured to prevent the speed selector 204 from being actuated from low to high-speed, e.g., without the tong 100 being set to neutral. The neutral setting for the tong 100 may be state of the tong 100 in which the tong is not hydraulically or otherwise being driven to rotate. Accordingly, the piston position sensing device 212, once recognizing that the speed selector 204 is in the low-speed setting at 402, may wait for a signal indicating that the tong is in neutral. If the neutral setting signal is not received, the method 400 may block actuation of the rotation speed selector 204 from the low-speed setting to the high-speed setting, as at 406. Once the signal that the tong is in neutral is received, the piston position sensing device 212 may permit actuation of the speed selector 204 to the high-speed setting, as at 408.

Figure 5:
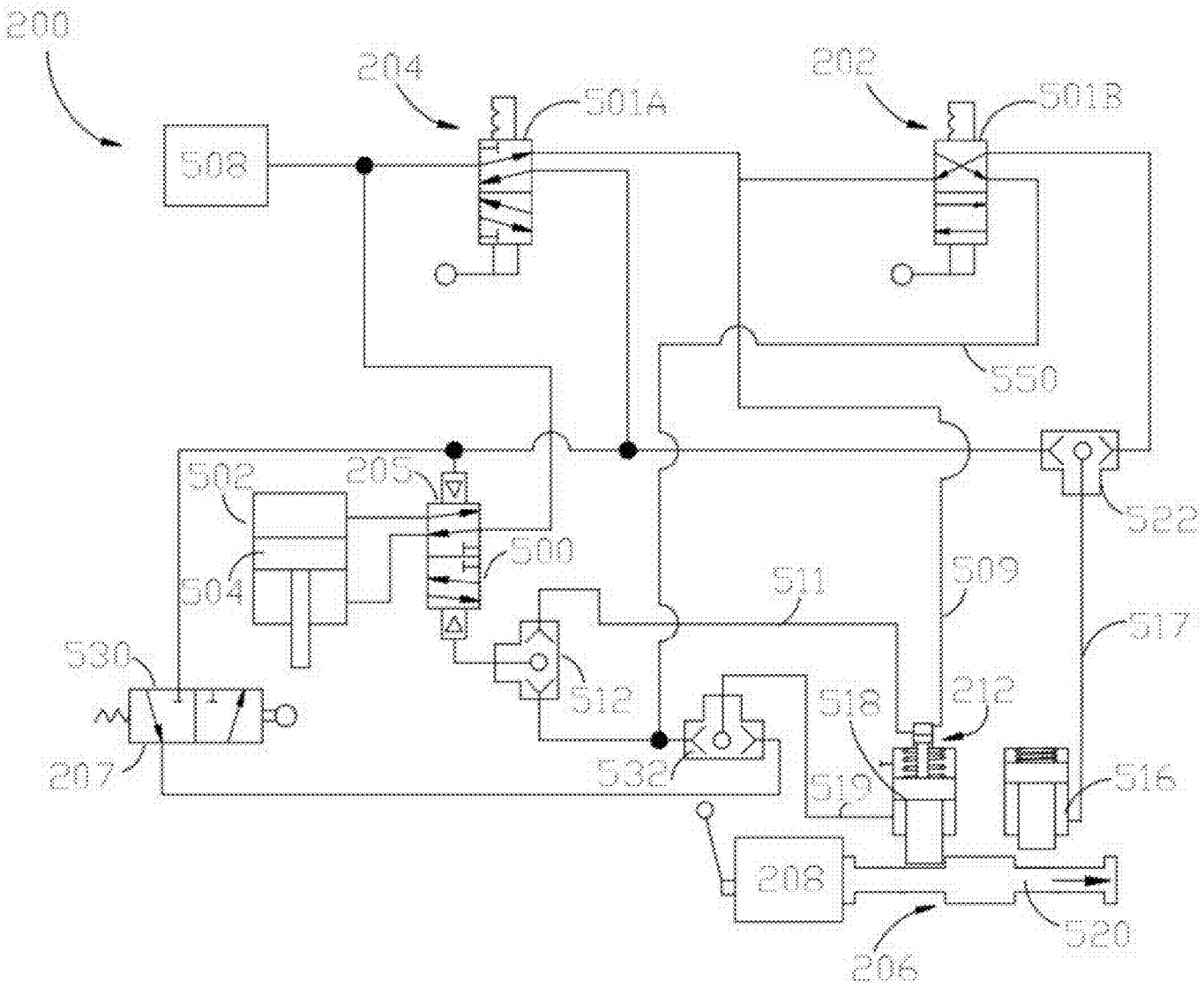
FIG. 5 illustrates a schematic view of the control system, according to an embodiment.

FIG. 5 illustrates a schematic view of a pneumatic circuit that implements the control system 200, according to an embodiment. It is emphasized that this pneumatic circuit is merely an example of one way to implement the control system 200, and one of ordinary skill in the art will recognize that mechanical, electrical, hydraulic, and/or at least partially computer-based systems may be implemented without departing from the scope of the present disclosure.

Referring to the specific, illustrated embodiment shown in FIG. 5, there is shown a speed selector valve 501A, which is actuated by the speed selector 204 (FIG. 2), and a run/pull mode selector valve 501B, which is actuated by the run/pull mode selector 202. The two positions available to each valve 501A, 501B may correspond to the high and low-speed settings for the rotation speed selector 204 and the first and second configurations of the run/pull mode selector 202, respectively. In their illustrated states, the valve 501A reflects the high-speed setting, and the valve 501B reflects the run configuration. As such, the system 200 is configured to permit rotation in the make-up direction.

The system 200 also includes the directional control valve 205, which, in this embodiment, is a pilot-actuated directional control valve 500 and a gear shift cylinder 502. The position of the rotation speed selector 204 (e.g., valve 501A) may determine to which "end" (representing pilot ports) of the pilot-actuated directional control valve 500 pressure is supplied, thereby controlling the position of the pilot-actuated directional control valve 500. Further, the low-speed indicator device 207 is shown as including a two-position directional control valve 530. The low-speed indicator device 207 may additionally include a mechanical linkage that is configured to change the position of the valve 530, as will be described in greater detail below.

In the configuration illustrated, pressure is received from a source 508, through the valve 501A, a line 509, the piston position sensing device 212 (which will be described in greater detail below), via a line 511, a shuttle valve 512, and to the "bottom" (as illustrated in the schematic) of the directional control valve 500. Pressure is also routed directly from the source 508 to the directional control valve 500, which the directional control valve 500 routes to the bottom of the gear shift cylinder 502, driving a piston 504 therein upward, resulting in a retraction of the gear shift cylinder, and thereby a selection of, for example, a high gear in the tong speed controller 210.

The valves 501A, 501B may communicate with a first piston 516 and a second piston 518, which may be configured to selectively allow or block linear motion of a spool 520. The pistons 516, 518 and the spool 520 may at least partially form the rotation change control device 206, which may be coupled to the tong motor control valve 208. The pistons 516, 518 may default (e.g., be biased to) to a lowered position, in which the pistons 516 each block movement of the spool 520 in at least one direction. In an embodiment, when a pressure signal is present in line 517, the first piston 516 may be raised, allowing movement of the spool 520 to the right, allowing the tong motor control valve 208 to rotate the tong 100 in the make-up direction. When a pressure signal is present in line 519, the second piston 518 may be raised, allowing movement of the spool 520 to the left, and causing the tong 100 to rotate in the break-out direction. When both pistons 516, 518 are raised, the spool 520 may be freely movable, and thereby cause rotation on the tong 100 in either direction, without additional modulation of the valves 501A, 501B or the selectors 202, 204 associated therewith. This satisfies blocks 314 and 316 in FIG. 3.

For example, with the selectors 202, 204 (and thus valves 501A, 501B) in their illustrated positions, pressure is routed through the valve 501A to the valve 501B, and then through a shuttle valve 522 to the first piston 516. This may raise the first piston 516, thereby allowing the spool 520 to move in at least one linear direction, e.g., right, as shown, from the illustrated neutral position. Allowing the spool 520 to move may allow for actuation of the tong motor control valve 208, in this case, to cause the tong 100 to rotate in the make-up direction. In this configuration, pressure is not routed to the second piston 518, and thus actuation of the spool 520 to the right is blocked by the second piston 518. This prevents actuation of the tong motor control valve 208 in the break-out direction. Accordingly, blocks 310 and 312 of FIG. 3 are satisfied.

When the rotation speed selector 204 is actuated to the low-speed setting, the valve 501A associated therewith changes position. As such, pressure is routed from the source 508, through the valve 501A, to the top of the pilot-actuated directional control valve 500, causing the pilot-actuated directional control valve 500 to actuate from its illustrated state and instead route pressure to the top of the gear shift cylinder 502. This drives the piston 504 downward, resulting in a low gear selection by the tong speed controller 210.

This selection actuates the valve 530 of the low-speed indicator device 207, e.g., via the mechanical linkage. The valve 530 may then route pressure through a shuttle valve 532 to the second piston 518, which raises the second piston 518. The raised second piston 518 may allow the spool 520 to translate to the left (as illustrated). Further, pressure may be routed from valve 501A to the first piston 516 via the shuttle valve 522, which causes the first piston 516 to lift away from the spool 520. As such, the spool 520 is able to actuate freely. Accordingly, with the run/pull mode selector 202 in the run mode, and the speed selector 204 in the low-speed setting, the tong motor control valve 208 may be movable to cause rotation in either direction, thereby satisfying blocks 314 and 316 from FIG. 3.

The pneumatic circuit illustrated as this example of the system 200 will similarly conform to the logic depicted in FIG. 3 if the valve 501B changes position, from the illustrated position, which corresponds to the run mode, to a position corresponding to the pull mode.

Accordingly, when a user attempts to actuate the speed selector 204 directly to high-speed, without first bringing the tong 100 to neutral (e.g., allowing both of the pistons 516, 518 to lower) the system 200 may not implement the gear shift. As shown in FIG. 5, the valve 501A is shifted to the high-speed setting, which directs pressure to the piston position sensing device 212, where it is blocked from reaching the shuttle valve 512 (or the directional control valve 205 beyond). Further, the shuttle valve 532 blocks pressure routed through the low-speed indicator device 207 from reaching the shuttle valve 512 or the pilot-actuated directional control valve 500. As such, until the piston position sensing device 212 is opened, which occurs when the second piston 518 is lowered, the actuation into the high-speed setting is prevented.

In the illustrated embodiment, when the valve 501B is in the opposite configuration to what is shown, i.e., in the pull mode, pressure is routed to a line 550. The line 550 may bypass the piston position sensing device 212 and provide pressure to the bottom of the pilot-actuated directional control valve 500, allowing the shifting of the valve 500 to the high-speed position, even if the piston position sensing device 212 is closed. As such, in this embodiment, when the system 200 is in the pull mode, the system 200 may permit actuation of the speed selector 204 from low to high, without first returning the tong 100 to neutral and allowing the pistons 516, 518 to fall. This may be permitted because other safety devices, such as snub lines, as described above, may prevent injury to an operator shifting to high in the pull mode. However, in other embodiments, the line 550 may instead route through the piston position sensing device 212 or a valve controlled by the position of the first piston 518, so as to further ensure safety of rig personnel by preventing direct speed shifting from low to high in the pull mode.

Figure 6:
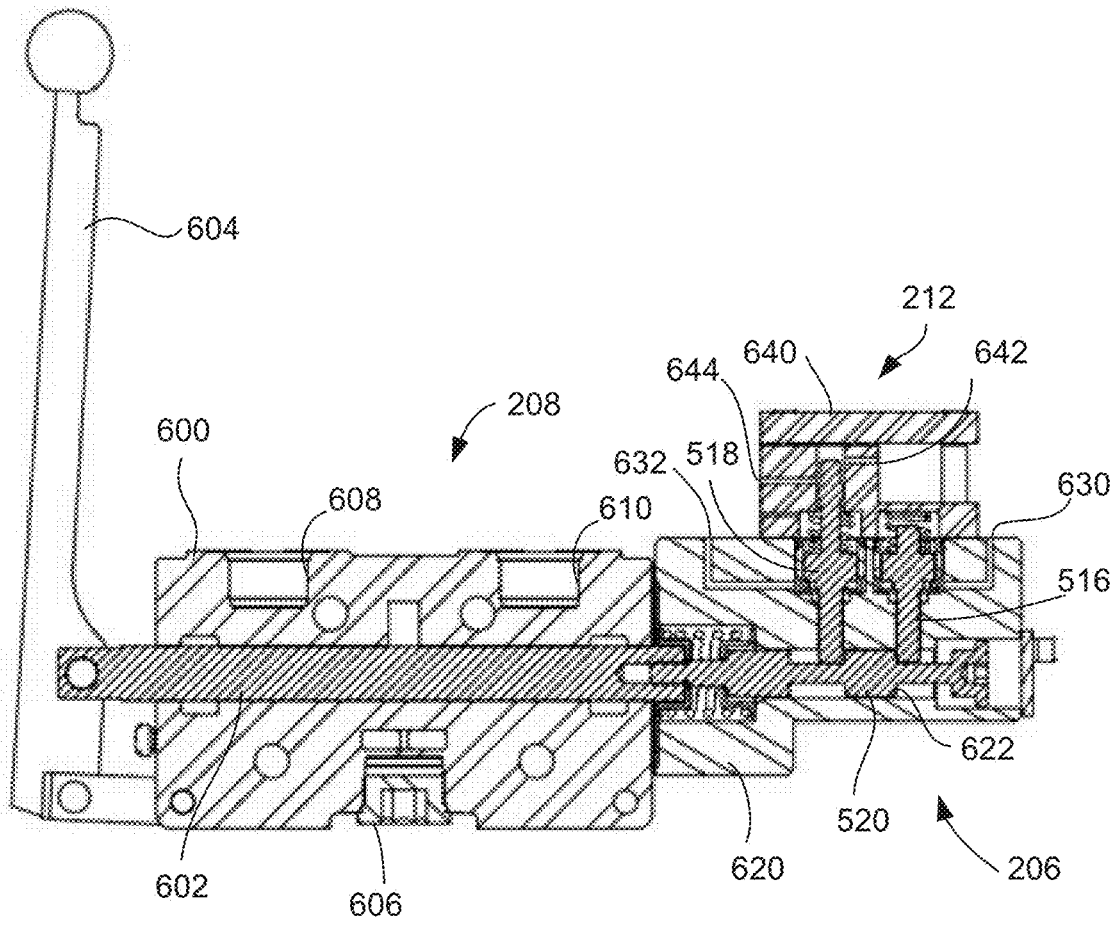
FIG. 6 illustrates a side, cross-sectional view of a tong motor control valve, a rotation change control device, and a piston position sensing device of the control system, according to an embodiment.

FIG. 6 illustrates a side, cross-sectional view of the tong motor control valve 208 and the rotation change control device 206, according to an embodiment. The tong motor control valve 208 may be selectively actuatable (e.g., manually, by operation of a user) to cause the tong 100 to rotate in either the first or second direction, and such selective actuation may be blocked or permitted via the rotation change control device 206.

As shown, the valve 208 may include a first housing 600 through which a spool 602 is received. A lever arm 604, which may be manipulated by a user, couples to the spool 602, and movement of the arm 604 left or right causes translation of the spool 602 within the first housing 600. The first housing 600 also includes an input port and two output ports 608, 610. Accordingly, the spool 602 may be translated from left-to-right to selectively allow communication between the input port and the output ports 608, 610, which are connected to respective ports of the tong motor. For example, when slid to the left, the spool 602 may permit communication through the first housing 600 between the input port and the output port 608 and through the motor port to which it is connected, while permitting fluid flow through the output port 610 to a return line. This results in the tong 100 rotating in the break-out direction. When slid to the right, the spool 602 may permit communication through the first housing 600 between the input port and the output port 610, while directing fluid flow from the output port 608 through a return line. This results in the tong 100 rotating in the make-up direction.

The illustrated embodiment of the rotation change control device 206 may include a housing 620 (referred as a "second" housing for contrast with the first housing 600), which may be coupled to the first housing 600. The second housing 620 may receive the spool 520 therein (the spool 602 may be referred to as a "first" spool, and the spool 520 may be referred to as a "second" spool, but this naming convention is merely to precisely identify the two spools, not to imply that one requires the other). The second spool 520 may be configured to move with the first spool 602. Further, if the second spool 520 is blocked from movement in one or both lateral directions, the first spool 602 may likewise be blocked. Blocking the first spool 602 may, in turn, block actuation of the tong motor control valve 208.

As was also shown in FIG. 5, the pistons 516, 518 may be configured to engage the spool 520. The second spool 520 may include a central shoulder 622, which may engage the pistons 516, 518 and block movement of the spool 520 therepast, unless the pistons 516, 518 are lifted away from the first spool 602. Moreover, the pistons 516, 518 may be biased toward the second spool 520, e.g., via a spring, such that the default position of the pistons 516, 518 is down, engaging the second spool 520.

Further, the second housing 620 may include first and second signal ports 630, 632. The first port 630 may communicate with the line 517 (FIG. 5), and the second port 632 may communicate with the line 519 (FIG. 5). Thus, as described above, when a pressure signal is present at the line 517 and the first port 630, the pressure raises the first piston 516, thereby allowing actuation of the second spool 520 to the left, and likewise allowing movement of the first spool 602 to the left, which causes the tong to rotate in the break-out direction. Likewise, when a pressure signal is present at the line 519 and the second port 632, the pressure raises the second piston 518, allowing movement of the second spool 520 and the first spool 602 to the right, which allows the tong motor control valve 208 to cause the tong 100 to rotate in the make-up direction.

The illustrated embodiment of FIG. 6 also includes the piston position sensing device 212, which is formed as a third housing 640 coupled to the second housing 620. The third housing 640 may form an input port 642 that communicates with the line 509 (FIG. 5), and an output port 644 that communicates with the line 511 (FIG. 5). When the piston 518 is raised, an extension 646 of the piston 518 blocks communication between the input port 642 and the output port 644. When the piston 518 is lowered, communication therebetween is permitted. Thus, since the piston 518 is raised when the speed selector 204 is in the low-speed setting, actuation of the speed selector 204 from the low-speed setting to the high-speed setting is only permitted when pressure is relieved in the system, e.g., the piston 518 is lowered.

Figure 7:
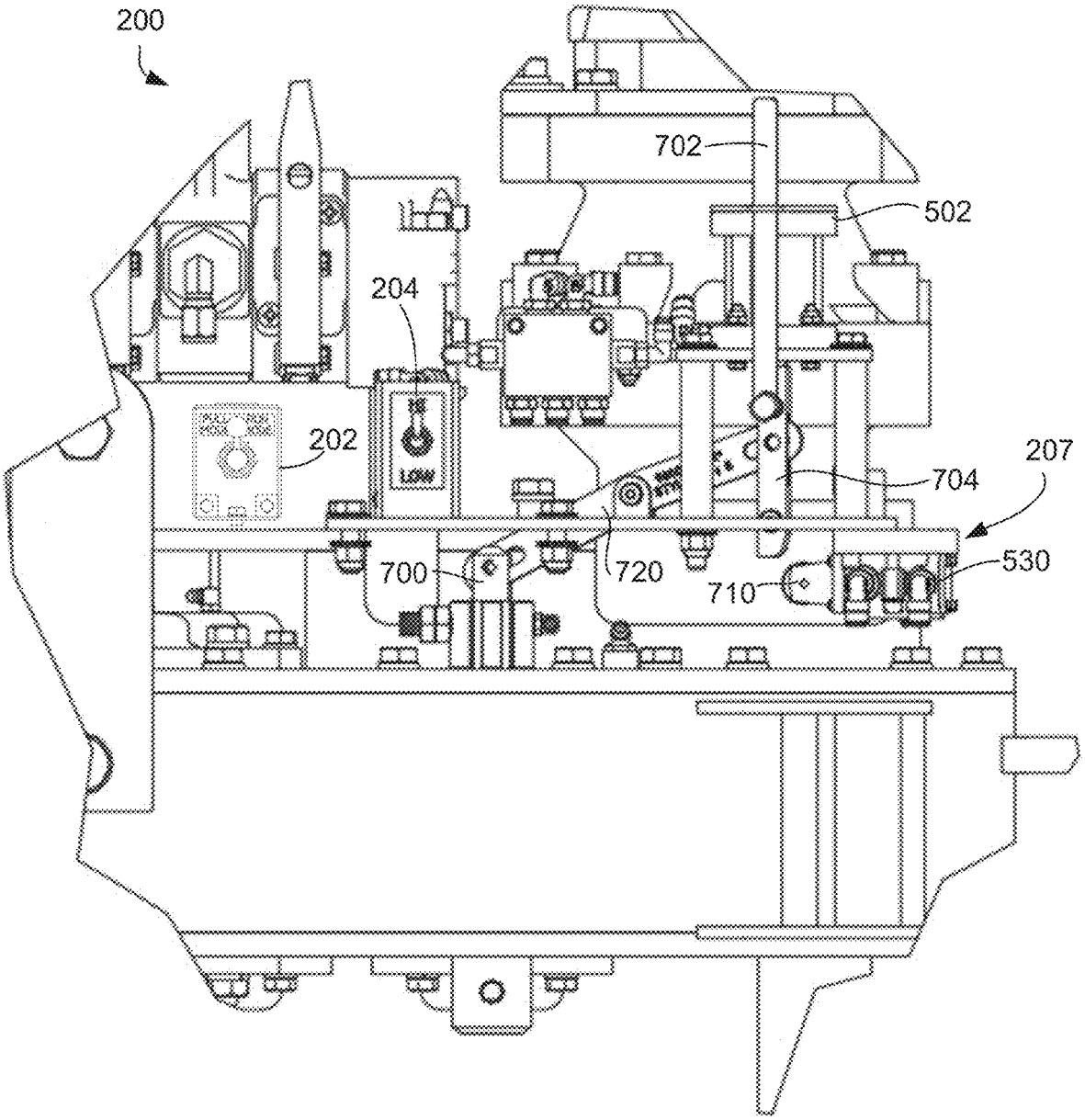
FIG. 7 illustrates a side view of a portion of the control system, according to an embodiment.

FIG. 7 illustrates a side view of a portion of the control system 200, according to an embodiment. In this view, the speed selector 204, the gear shift cylinder 502, and the low-speed indicator device 207 are visible. As discussed above, actuation of the speed selector 204 may toggle between the high and low-speed setting, which, if permitted, determines the position of the valve 501A. Also visible in FIG. 7 is an example of the run/pull mode selector 202, which may be a rotary switch movable between a run mode (e.g., first configuration) and a pull mode (e.g., second configuration), as indicated.

A linkage connects together the gear shift cylinder 502 and a tong gear change mechanism. The tong gear change mechanism may include a shift shaft 700, movement of which may shift gears in the tong gear change mechanism. The linkage may include one or more rods, brackets, braces, etc. For purposes of illustration, the present embodiment includes a guide shaft 702 and an indicator shaft 704, which are coupled together. Further, the input shaft 702 is also coupled to the gear shift cylinder shaft, so as to be movable vertically therewith. The output shaft 704 is also coupled to the shift shaft 700 via a toggle mechanism 720. Accordingly, movement of the gear shift cylinder output shaft downwards (e.g., to a low-gear position) in response to the selector 204 being moved to the low-speed setting may cause the guide shaft 702 to move downwards. This downwards movement is also transmitted to the indicator shaft 704, which in turn the shift shaft 700 to move upwards. When the selector 204 is actuated to the high-speed setting, the gear shift cylinder 502 moves upward, and the shafts 702, 704 move the shift shaft 700 downwards, thereby shifting to the high gear setting.

In addition, the indicator shaft 704 may contact an actuator 710 of the low-speed indicator device 207 when the gear shift cylinder 502 is in the low-speed position (i.e., moved downward from the position illustrated). When contacted, the actuator 710 may shift the valve 530 from its default position (illustrated in FIG. 5), to the opposite position, which may confirm that the tong 100 is being operated in the low-speed setting.

Figure 8:
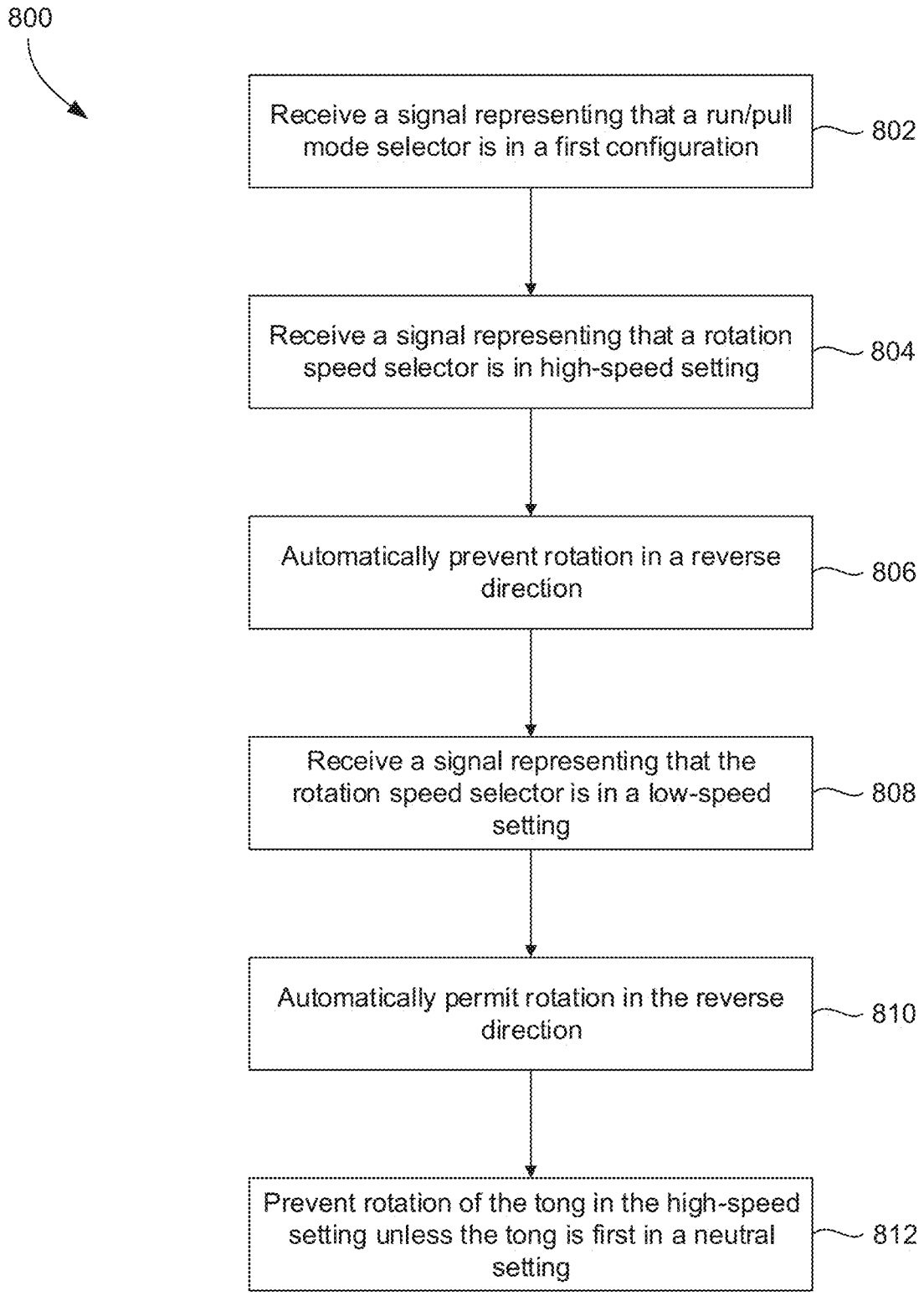
FIG. 8 illustrates a flowchart of a method for controlling a tong, according to an embodiment.

FIG. 8 illustrates a flowchart of a method 800 for controlling a tong, e.g., the tong rotation and/or speed, according to an embodiment. The method 800 may include receiving a signal representing that a run/pull mode selector is in a first configuration, as at 802. The tong may be configured to rotate primarily in a first, make-up direction when the run/pull mode selector is in the first configuration, but may, under certain conditions, be permitted to rotate in a second, break-out direction, e.g., to address cross-threading.

The method 800 may also include receiving a signal representing that a rotation speed selector is in a high-speed setting, as at 804. The tong is configured to rotate at a first speed when the rotation speed selector is in the high-speed setting. The method 800 may also include automatically (e.g., without intervention by a human operator) preventing rotation of the tong in the second direction until receiving a signal representing that the rotation speed selector has been actuated to the low-speed setting, as at 806. In an embodiment, the method 800 may also include receiving a signal representing that the rotation speed selector is in (e.g., has been actuated to) a low-speed setting, as at 808. In response, the method 800 may proceed to automatically permitting rotation of the tong in the second direction, as at 810. Permitting actuation at 808 may include actuating a low-speed indicator device in response to the rotation speed selector being in the low-speed setting. In an embodiment, actuating the low-speed indicator device is performed using a mechanical linkage between a gear shift valve and the low-speed indicator device.

The method 800 may also include preventing actuation of the rotation speed selector to the high-speed setting, while the tong is operating in the low-speed setting (e.g., in response to receiving the signal that the rotation speed selector is in the low-speed setting), as at 812. The method 800 may also include permitting actuation of the rotation speed selector to the high-speed setting in response to receiving a signal representing that the tong is in a neutral setting.

In one specific embodiment, the method 800 may further include blocking the execution of the rotation speed selectors output commands in response to receiving signals from the interlock system that the tong is operating in either the make up or break out direction. Accordingly, preventing rotation in the second direction may include blocking the spool from moving in at least one direction using a second piston in a lowered position. The method 800, may include moving at least one of the first or second pistons to permit movement of the rotation change control device in response to signals from the interlock system that the tong motor control valve is in the neutral condition.

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

While the present teachings have been illustrated with respect to one or more implementations, alterations and/or modifications may be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. A control system for a tong for a drilling rig, the control system comprising:

a tong motor control valve that is selectively actuatable to cause rotation of the tong in a first direction or in a second direction;

a run/pull mode selector configured to actuate between a first configuration for running tubulars into a well and a second configuration for pulling tubulars from the well;

a rotation speed selector configured to actuate between a high-speed setting configured to cause the tong to be driven to rotate at a first speed, and a low-speed setting configured to cause the tong to be driven to rotate at a second speed, the first speed being greater than the second speed; and a rotation change control device configured to selectively prevent or permit actuation of the tong motor control valve based on whether the run/pull mode selector is in the first configuration or the second configuration and whether the rotation speed selector is in the high-speed setting or the low-speed setting.

2. The control system of claim 1, wherein, when the run/pull mode selector is in the first configuration, and the rotation speed selector is in the high-speed setting, the rotation change control device permits actuation of the tong motor control valve to cause rotation of the tong in the first direction at the first speed and blocks actuation of tong motor control valve to cause rotation of the tong in the second direction.

3. The control system of claim 1, wherein, when run/pull mode selector is in the first configuration, and the rotation speed selector is in the low-speed setting, the rotation change control device permits actuation of the tong motor control valve to cause rotation in either of the first direction or the second direction.

4. The control system of claim 1, wherein, when the run/pull mode selector is the second configuration, and the rotation speed selector is the high-speed setting, the rotation change control device permits actuation of the tong motor control valve to cause rotation of the tong in the second direction at the first speed and blocks actuation of the tong motor control valve to cause the tong to rotate in the first direction.

5. The control system of claim 1, wherein, when run/pull mode selector is the second configuration, and the rotation speed selector is in the low-speed setting, the rotation change control device permits actuation of the tong motor control valve to cause the tong to rotate in the second direction at the second speed and permits actuation of the tong motor control valve to cause the tong to rotate in the first direction at the second speed.

6. The control system of claim 1, further comprising a piston position sensing device, wherein the tong has a neutral setting in which the tong not driven to rotate, and wherein the rotation change control device is configured to prevent the tong from rotating at the second speed after rotating in the first speed unless the tong is in a neutral setting therebetween, at least when the run/pull mode selector is in the first configuration.

7. The control system of claim 6, wherein the piston position sensing device is configured to permit the tong to rotate at the second speed after rotating at the first speed without the tong being in the neutral setting when the run/pull mode selector is in the second configuration.

8. The control system of claim 1, wherein:

the tong motor control valve comprises a housing defining an input port, a first output port, and a second output port, and a first spool that is slidable within the housing, wherein, to cause the tong to rotate in the first direction, the first spool slides to allow the input port to communicate with the first output port via the first spool, and blocks the input port from communication with the second output port, and wherein, to cause the tong to rotate in the second direction, the first spool slides to allow the input port to communicate with the second output port and blocks the input port from communication with the first output port; and the rotation change control device comprises:

a second housing coupled to the first housing, wherein the second housing defines first and second signal ports;

a second spool coupled to the first spool and configured to move therewith; and one or more pistons configured to permit or block movement of the second spool, and thereby permit or block movement of the first spool, in response to one or more signals received at the first and/or second signal ports.

9. A method for controlling a tong, comprising:

receiving a signal, at a rotation change control device, representing that a run/pull mode selector is in a first configuration associated with running tubulars into a well;

receiving a signal, at the rotation change control device, representing that a rotation speed selector is in a high-speed setting, wherein the tong is configured to rotate at a first speed when the rotation speed selector is in the high-speed setting; and automatically permitting actuation of the rotation change control device and a tong motor control valve to cause the tong to rotate in a make-up direction; and automatically preventing actuation of the rotation change control device and the tong motor control valve to cause the tong to rotate in a break-out direction that is opposite to the make-up direction, until receiving a signal representing that the rotation speed selector has been actuated to a low-speed setting, wherein the tong is configured to operate at a second speed that is less than the first speed when the rotation speed selector is in the low-speed setting.

10. The method of claim 9, further comprising:

receiving a signal representing that the rotation speed selector is in the low-speed setting; and in response to receiving the signal representing that the rotation speed selector is in the low-speed setting, automatically permitting actuation of the rotation change control device and the tong motor control valve to cause rotation of the tong in the break-out direction.

11. The method of claim 10, wherein automatically permitting actuation of the rotation change control device and the tong motor control valve to cause rotation of the tong in the break-out direction comprises actuating a low-speed indicator device in response to the rotation speed selector being in the low-speed setting, wherein actuating the low-speed indicator device is performed using a mechanical linkage between a gear shift valve and the low-speed indicator device.

12. The method of claim 10, further comprising preventing actuation of the rotation speed selector to the high-speed setting in response to receiving the signal that the rotation speed selector is in the low-speed setting.

13. The method of claim 12, further comprising permitting actuation of the rotation speed selector to the high-speed setting in response to receiving a signal representing that the tong is in a neutral setting.

14. The method of claim 9, further comprising raising a first piston from a lowered position that blocks movement of a spool coupled to the tong motor control valve in response to receiving the signal that the run/pull mode selector is in the first configuration, wherein preventing actuation tong motor control valve comprises blocking the spool from moving in at least one direction using a second piston in a lowered position.

15. The method of claim 14, further comprising raising the second piston in response to receiving a signal that the rotation speed selector is in the low-speed setting.

16. The method of claim 15, wherein raising the second piston comprises closing a valve of a piston position sensing device, wherein closing the valve prevents actuation of the rotation speed selector from the low-speed setting to the high-speed setting.

17. A tong, comprising:

gripping jaws configured to grip a tubular;

a motor configured to rotate the jaws and thereby rotate the tubular in either a make-up direction or a break-out direction; and a control system in communication with the motor, the control system comprising:

a tong motor control valve that is selectively actuatable to cause rotation of the tong in a first direction or in a second direction;

a run/pull mode selector configured to actuate between a first configuration for running tubulars into a well and a second configuration for pulling tubulars from the well;

a rotation speed selector configured to actuate between a high-speed setting configured to cause the motor to drive the tong to rotate at a first speed, and a low-speed setting configured to cause the motor to drive the tong to rotate at a second speed, the first speed being greater than the second speed; and a rotation change control device configured to selectively prevent or permit actuation of the tong motor control valve based on whether the run/pull mode selector is in the first configuration or the second configuration and whether the rotation speed selector is in the high-speed setting or the low-speed setting.

18. The tong of claim 17, wherein:

when the run/pull mode selector is in the first configuration, and the rotation speed selector is in the high-speed setting, the rotation change control device permits actuation of the tong motor control valve to cause rotation of the tong in the first direction at the first speed and blocks actuation of tong motor control valve to cause rotation of the tong in the second direction;

when run/pull mode selector is in the first configuration, and the rotation speed selector is in the low-speed setting, the rotation change control device permits actuation of the tong motor control valve to cause rotation in either of the first direction or the second direction;

when the run/pull mode selector is the second configuration, and the rotation speed selector is the high-speed setting, the rotation change control device permits actuation of the tong motor control valve to cause rotation of the tong in the second direction at the first speed and blocks actuation of the tong motor control valve to cause the tong to rotate in the first direction; and when run/pull mode selector is the second configuration, and the rotation speed selector is in the low-speed setting, the rotation change control device permits actuation of the tong motor control valve to cause the tong to rotate in the second direction at the second speed and permits actuation of the tong motor control valve to cause the tong to rotate in the first direction at the second speed.

19. The tong of claim 17, wherein the control system further comprises a piston position sensing device, wherein the tong has a neutral setting in which the tong not driven to rotate, and wherein the speed change controller is configured to prevent the tong from rotating at the second speed after rotating in the first speed unless the tong is in a neutral setting therebetween, at least when the run/pull mode selector is in the first configuration, wherein the piston position sensing device is configured to permit the tong to rotate at the second speed after rotating at the first speed without the tong being in the neutral setting when the run/pull mode selector is in the second configuration.

20. The tong of claim 17, wherein:

the tong motor control valve comprises a housing defining an input port, a first output port, and a second output port, and a first spool that is slidable within the housing, wherein, to cause rotating in the first direction, the spool slides to allow the input port to communicate with the first output port via the first spool, and blocks the input port from communication with the second output port, and wherein, to cause rotation of the tong in the second direction, the first spool slides to allow the input port to communicate with the second output port and blocks the input port from communication with the first output port;

the rotation change control device comprises:

a second housing coupled to the first housing, wherein the second housing defines first and second signal ports;

a second spool coupled to the first spool and configured to move therewith; and one or more pistons configured to permit or block movement of the second spool, and thereby permit or block movement of the first spool, in response to one or more signals received at the first and/or second signal ports.

* * * * *